United States Patent [19]

Gobush et al.

[11] Patent Number: 5,054,785

[45] Date of Patent: Oct. 8, 1991

[54] GAME BALL SUPPORT DEVICE AND PIEZOELECTRIC BALL MOTION DETECTOR

[75] Inventors: William Gobush, North Dartmouth; Charles Days, South Dartmouth, both of Mass.

[73] Assignee: Acushnet Company, New Bedford, Mass.

[21] Appl. No.: 629,437

[22] Filed: Dec. 18, 1990

[51] Int. Cl.[5] ..... A63B 69/36

[52] U.S. Cl. ..... 273/184 R; 354/120; 273/186 R; 273/183 A

[58] Field of Search ..... 273/186 R, 186 B, 186 C, 273/183 A, 213, 183 R, 183 C, 183 E, 33, 195 R, 184 R, 185 R, 185 A, 185 B, 185 C, 185 D, 201; 354/120

[56] References Cited

U.S. PATENT DOCUMENTS

| | | | |
|---|---|---|---|
| 2,783,999 | 3/1957 | Simjian | 273/185 B X |
| 2,933,681 | 4/1960 | Crain | 273/186 R X |
| 3,160,011 | 12/1964 | Ogden | 273/186 R X |
| 3,992,012 | 11/1976 | Campbell | 273/186 R |
| 4,063,259 | 12/1977 | Lynch et al. | 273/185 R X |
| 4,223,891 | 9/1980 | Gaasbeek | 273/186 R |
| 4,306,723 | 12/1981 | Rusnak | 273/186 R |
| 4,991,850 | 2/1991 | Wilhelm | 273/186 A |

OTHER PUBLICATIONS

"Prezo Film Sensing Devices", William B. Powers, Society of Manufacturing Engineers, Conference held Nov. 11-13, 1986, Detroit, Michigan.

*Primary Examiner*—George J. Marlo
*Attorney, Agent, or Firm*—Lucas & Just

[57] ABSTRACT

A piezoelectric motion detector is disclosed. The device is particularly suitable for use in analyzing a golf ball when hit from a golf tee. A piezoelectric film is affixed to the bottom of a tee having a base. A signal generated by the piezoelectric film is amplified and is used, for example, to open a camera shutter and initiate a sequence of light flashes.

4 Claims, 2 Drawing Sheets

GAME BALL SUPPORT DEVICE AND PIEZOELECTRIC BALL MOTION DETECTOR

The present invention relates to golf and, in particular, a highly effective sensor for detecting the moment when a golf ball is first struck by a golf club. Such a detector is useful in analysis of the golf ball, the golf club, and the swing of the golfer.

Figure 1:
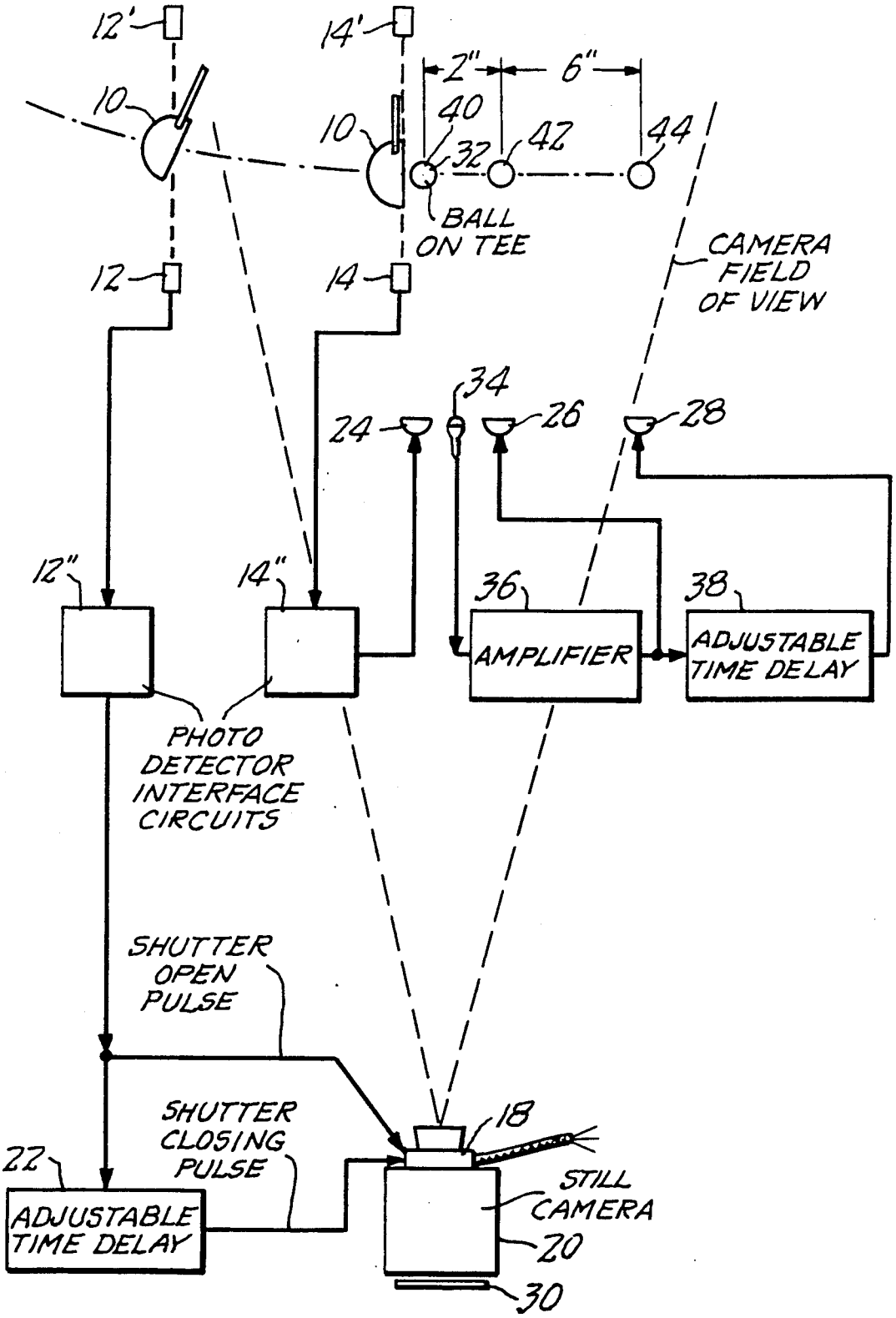
FIG. 1. (PRIOR ART)

Analysis of a golf swing and the related factors, including the motion of the golf ball and the golf club, is well known in the art and is taught, for example, in U.S. Pat. No. 4,063,259 issued Dec. 13, 1977 which is commonly assigned with the instant application. FIG. 1 of that patent shows a typical analysis of a golf swing and teaches two different methods of initiating camera and stroboscopic operation. The club head breaks a light beam which is detected by a photodetector which then opens the shutter of a camera. Thereafter, when the golf club impacts the ball, the sound is picked up by a microphone which sets off strobes. It will be appreciated that the microphone could be eliminated and that a second light beam/photodetector could be used following the ball to initiate the strobes. However, both a microphone and a photodetector have inherent limitations. The most serious of these limitations is the effect of ambient conditions. A cloud which breaks and lets the sun shine through or a tree leaf which flutters and then releases the sunlight can cause erratic or erroneous operation of a light beam/photodetector. Furthermore, since a photodetector relies on a beam of light for activity, there is always a light operating, which can be a distraction to the golfer. The microphone is also subject to the vagaries of ambient conditions and can be erroneously activated by a sharp sound in the area, such as from others golfers or equipment being operated nearby.

We have now discovered an activation device which overcomes the disadvantages of both photodetectors and sound activators. The device which we have discovered does not rely on light or sound for activation and is thus not affected by either one. Furthermore, the device of our invention is not visible to the golfer and therefore does not distract the golfer's attention from making a proper shot.

The device according to the present invention is based on a piezoelectric film. Piezoelectric films are well known in the art. These materials react to very small changes in pressure by generating an electric current. This electric current can then be used as a trigger in an operation such as that disclosed in U.S. Pat. No. 4,063,259, the teaching of which is incorporated herein by reference. The piezoelectric film is suitably attached to the bottom of a rubber tee which has a flat base. Such tees are well known in the art and are commonly used at golf driving ranges. The piezoelectric film is affixed to the underside of the base of the rubber tee with a suitable adhesive, preferably one which is flexible, such as those used to affix urethane shoe soles. The piezoelectric film generally comes from the supplier with electrical leads attached, one lead being attached to the outside of the film and the other lead being attached to the inside of the film. We have found that it is preferable to utilize the outside film lead as the ground since this helps to reduce electrostatic pick-up.

Figure 2:
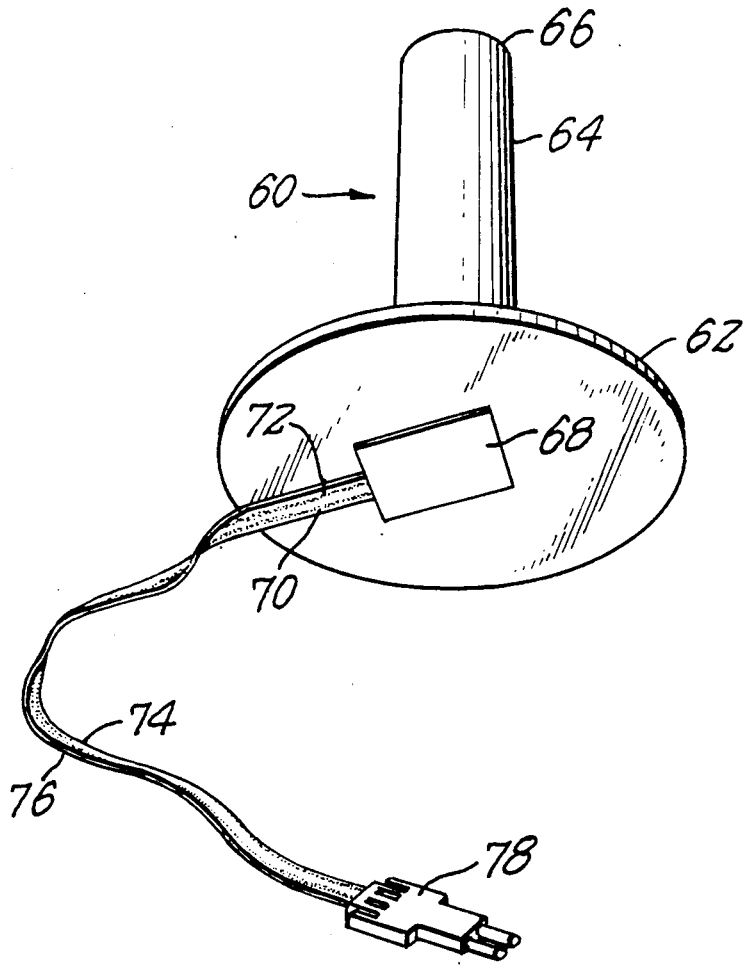

These and other aspects of the present invention may be understood by reference to the accompanying figures in which:

FIG. 1 is a reproduction of FIG. 1 of U.S. Pat. No. 4,063,259 (prior art); and FIG. 2 shows the device of the present invention.

Referring first to FIG. 1, a golf club head 10 passes between a series of photodetectors and corresponding light sources 12, 12' and 14, 14' respectively. Photodetectors 12 and 14 are connected to photodetector interface circuits 12'' and 14'' respectively. Circuit 12'-12-12'' is activated when the club head 10 breaks the beam between light source 12' and photodetector 12. This causes simultaneous opening of the electrically activated shutter of the camera 20 and activation of time delay 22. The time delay 22 closes the shutter at a preselected interval (suitably 5 to 15 milliseconds) after activation and is preferably made adjustable to compensate for varying time openings depending on the conditions needed.

Circuit 14'-14-14'' activates, on interruption of the light beam by the club head 10, a flash of light from light source 24. Light source 24 and subsequent light sources 26 and 28 are suitably xenon lights with appropriate light intensity and short flash time duration. For shady ambient conditions, the intensity of the light source is preferably at least 10 million lux at 1 meter. For full sunlight, the intensity of the light source is preferably at least 100 million lux at 1 meter.

The duration of the flash is controlled to give essentially stop action of the club head and the golf ball. Because of the speed with which the club head and golf ball will normally be travelling, the duration of the flash is suitably no more than 100 microseconds and preferably no more than 1 microsecond. Light source 24 produces an image of the club head 10 on the camera film 30 at the moment just before impact with the ball whereby the loft angle of the club can be measured as can the initial point in measuring launch angle.

When the club head 10 strikes the golf ball 32, which is mounted on a tee (not shown), an audible "click" will be produced. This will be picked up by microphone 34 which will generate a signal increased in intensity by amplifier 36 for activation of light source 26 and time delay 38. The time delay, preselected for a given interval of time, activates light source 28, suitably 0.5 to 5 milliseconds after activation of light source 26.

As shown, microphone 34 is spaced a suitable distance from golf ball 32. The purpose for this is to delay slightly the taking of the first image until the ball has resumed substantially its normal shape after compression by golf club head 10. For example, if microphone 34 is 9 inches (23 cm) away from the golf ball, then light source 26 will be activated approximately 1 millisecond after the golf ball contacts the face of the club head 10.

After light source 28 has been actuated, the electrically actuated shutter 18 closes due to time delay 22.

It will be appreciated that various modifications of the instant apparatus can be made. For example, microphone 34 can be replaced by a photodetector and light source. However, in accordance with the present invention, the microphone is replaced with the tee of the present invention. As shown in FIG. 2, the tee of the present invention is a standard golf tee fixture 60 with a base 62 and tee portion 64. As is well known in the art, a golf ball rests on the top 66 of tee portion 64. Affixed to the base 62 of tee 60 is a piezoelectric film 68 having an inside lead 70 and an outside lead 72. The piezoelectric film 68 is affixed to the base 62 of the tee 60 with #2216 adhesive available from 3M Company.

In one preferred embodiment of the present invention, the tee 60 is made predominantly of natural rubber, the base 62 is approximately $2\frac{1}{2}$ inches (about 6 cm) in diameter and the height of the tee portion 64 is about 2 inches (about 5 cm). The piezoelectric film 18 secured to the base is about $\frac{1}{2}$ inch by $1\frac{1}{4}$ inches (about $1\frac{1}{4}$ cm by 3 cm) in dimension.

The device shown in FIG. 2 was obtained from ATOCHEM Sensors, Inc. as stock number FDTl-028K and came affixed with leads 70 and 72. Additional lead wires 74 and 76 are attached to the leads 70 and 72 respectively, and terminate in a pinned plug 78. The pinned plug can then be inserted into the circuitry shown in U.S. Pat. No. 4,063,259 as a replacement for either the photodetector or the microphone, or both. Because of the fluctuation in voltage generated by the piezoelectric film as compared to that generated by a microphone or a photodetector, we prefer to use a voltage control circuit between the photoelectric film and the other circuitry. We used a voltage control circuit known by the acronym PTC which we obtained from Clarke Engineering of Mattapoisett, Mass.

The actual piezoelectric switch which we used responded within about 50 microseconds of the time that the club head impacted the ball. This is a substantial improvement over the 1 millisecond for a photodetector or the even longer period for a microphone. With a 50 microsecond delay, the first strobe can be activated when the ball is only about 1/100 inch (about $\frac{1}{4}$ mm) away from the club face. This is very favorable compared to the distances of $2\frac{1}{2}$–3 inches (about $6\frac{1}{2}$–$7\frac{1}{2}$ cm) which the ball generally travels before the first strobe of light in the device of U.S. Pat. No. 4,063,259.

While it is not necessary that the tee 60 be held in position, we prefer to retain it in position with upper and lower clamping means (not shown) so that it doesn't become inadvertently dislodged and cause damage to the piezoelectric film.

It will be understood that the primary benefit of the present invention is its use in the game of golf. However, such use is not necessarily limited to analysis as described hereinbefore. It could, for example, be routinely used on a golf course to warn golfers down the fairway at the time that the following group tees off. Similarly, while the device is primarily intended for use with live golfers, it can also be used to considerable advantage with mechanical golfers. Furthermore, the device could also be used within other areas where one implement is used to launch another implement, such as where a baseball on top of a batting tee is hit by a batter.

Because of the many changes which can be contemplated, it will be understood that the claims are intended to cover all changes and modifications of the preferred embodiments of the invention herein chosen for the purpose of illustration which do not constitute a departure from the spirit and scope of the invention.

What is claimed is:

1. In a flexible golf tee for holding a golf ball to be struck having a tee portion and a base portion, the improvement comprising a piezoelectric film in contact with said base portion in a condition in which it will produce a voltage upon the striking of said golf ball.

2. The golf tee of claim 1 wherein the piezoelectric film is affixed to the base of the golf tee.

3. The golf tee of claim 1 wherein the piezoelectric film has leads which extend from the inside and outside of said film and the outside lead is the electrical ground.

4. A device for holding a game ball to be launched by the striking thereof with a game implement, said device having a place thereon for said game ball to rest and said device having a piezoelectric switch attached thereto in a condition in which it will produce a voltage upon the striking of said game ball with said game implement.

* * * * *